US009541871B2

(12) United States Patent
Ishida

(10) Patent No.: US 9,541,871 B2
(45) Date of Patent: Jan. 10, 2017

(54) FIXING DEVICE HAVING STAY AND COVER FIXED THERETO BY SPRING

(71) Applicant: Brother Kogyo Kabushiki Kaisha, Nagoya-shi, Aichi-ken (JP)

(72) Inventor: Kei Ishida, Inuyama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/014,077

(22) Filed: Feb. 3, 2016

(65) Prior Publication Data

US 2016/0231673 A1 Aug. 11, 2016

(30) Foreign Application Priority Data

Feb. 6, 2015 (JP) ..... 2015-021723

(51) Int. Cl.
*G03G 15/20* (2006.01)

(52) U.S. Cl.
CPC .. *G03G 15/2053* (2013.01); *G03G 2215/2035* (2013.01)

(58) Field of Classification Search
CPC ..... G03G 15/2053; G03G 15/2064; G03G 2215/2016; G03G 2215/2022; G03G 2215/2025; G03G 2215/2029; G03G 2215/2035; G03G 2215/2038
USPC ..... 399/329
See application file for complete search history.

(56) References Cited

U.S. PATENT DOCUMENTS 9,020,408 B2 4/2015 Suzuki et al.
2012/0308276 A1* 12/2012 Miyauchi ..... G03G 15/2053 399/329
2013/0071156 A1 3/2013 Suzuki et al.
2013/0322939 A1* 12/2013 Ishida ..... G03G 15/2053 399/329
2014/0294419 A1* 10/2014 Matsuno ..... G03G 15/2042 399/69
2014/0294458 A1* 10/2014 Jeon ..... G03G 15/2053 399/329
2015/0227092 A1 8/2015 Suzuki et al.
2015/0277314 A1* 10/2015 Hazeyama ..... G03G 15/2053 399/329
2016/0091845 A1* 3/2016 Hiramatsu ..... G03G 15/2053 399/329
2016/0132007 A1* 5/2016 Eiki ..... G03G 15/2053 399/329

FOREIGN PATENT DOCUMENTS

JP 2013-068659 A 4/2013

* cited by examiner

*Primary Examiner* — Sophia S Chen
(74) *Attorney, Agent, or Firm* — Banner & Witcoff, Ltd.

(57) ABSTRACT

A fixing device includes a fixing belt, a heater, a nip plate, a pressure roller, a stay, a cover, and a spring. The fixing belt has an inner surface. The heater is configured to heat the fixing belt. The nip plate is configured to contact the inner surface. The pressure roller is configured to press the fixing belt in cooperation with the nip plate. The stay is provided at a position opposite to the pressure roller with respect to the nip plate. The stay is configured to receive a force applied to the nip plate from the pressure roller. The cover is configured to cover the stay. The spring includes a first portion configured to urge the stay to the cover, and a second portion configured to urge the cover to the stay.

17 Claims, 5 Drawing Sheets

FIXING DEVICE HAVING STAY AND COVER FIXED THERETO BY SPRING

CROSS REFERENCE TO RELATED APPLICATION

This application claims priority from Japanese Patent Application No. 2015-021723 filed Feb. 6, 2015. The entire content of the priority application is incorporated herein by reference.

TECHNICAL FIELD

The present disclosure relates to a fixing device for thermally fixing a developer image formed onto a sheet.

BACKGROUND

Japanese Patent Application publication No. 2013-68659 discloses a fixing device for thermally fixing developer image onto a recording sheet. The fixing device includes a tubular fixing belt, a nip plate in contact with an inner peripheral surface of the fixing belt, a pressure roller for nipping the fixing belt in cooperation with the nip plate, a stay supporting the nip plate, and a cover covering the stay.

SUMMARY

According to the disclosed structure, the stay and the cover are fixed to each other by threads. Therefore, cutting chips may be generated during threading engagement of the thread with the stay. The cutting chips may damage to the inner peripheral surface of the fixing belt, if the cutting chips are deposited onto the surface.

It is therefore an object of the present disclosure to provide a fixing device capable of restraining generation of cutting chips when fixing the stay and the cover to each other.

This and other objects will be attained by providing a fixing device including a fixing belt, a heater, a nip plate, a pressure roller, a stay, a cover, and a spring. The fixing belt has an inner surface. The heater is configured to heat the fixing belt. The nip plate is configured to contact the inner surface. The pressure roller is configured to press the fixing belt in cooperation with the nip plate. The stay is provided at a position opposite to the pressure roller with respect to the nip plate. The stay is configured to receive a force applied to the nip plate from the pressure roller. The cover is configured to cover the stay. The spring includes a first portion configured to urge the stay to the cover, and a second portion configured to urge the cover to the stay.

BRIEF DESCRIPTION OF THE DRAWINGS

The particular features and advantages of the disclosure will become apparent from the following description taken in connection with the accompanying drawings, in which.

The particular features and advantages of the disclosure as well as other objects will become apparent from the following description taken in connection with the accompanying drawings, in which.

DETAILED DESCRIPTION

Firstly, an image forming device, i.e., a laser printer 1 provided with a fixing device according to an embodiment will be described with reference to FIG. 1.

Directions in the following description will be based on an assumption that the printer 1 is disposed in an orientation in which it is intended to be used. Specifically, the left side of the printer 1 in FIG. 1 will be called the "front," the right side will be called the "rear," the near side will be called the "right," and the far side will be called the "left." Further, the "top" and "bottom" of the printer 1 will correspond to the vertical direction in FIG. 1.

Figure 1:
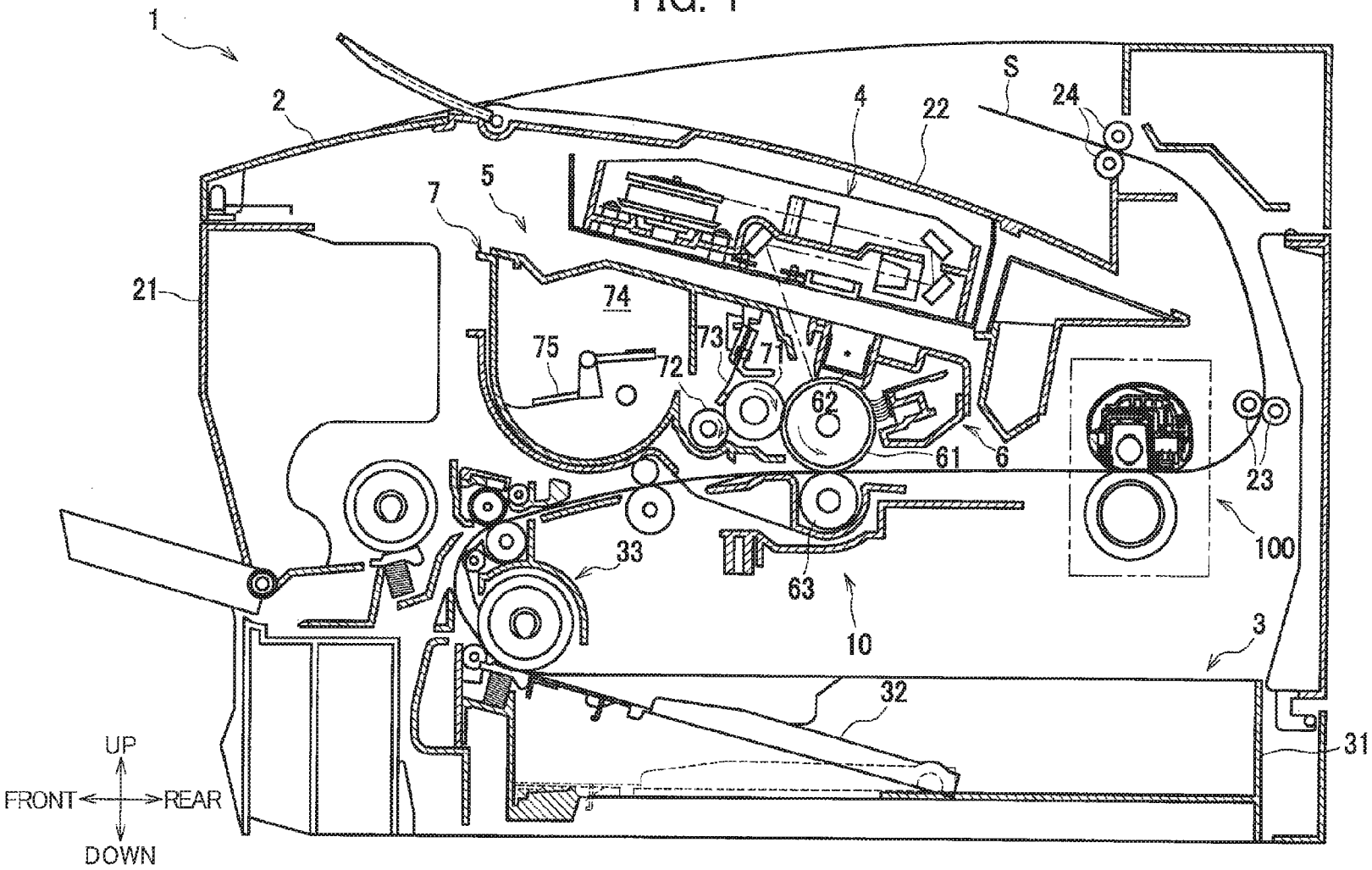
FIG. 1 is a cross-sectional view of an image forming device provided with a fixing device according to en embodiment.

As shown in FIG. 1, the printer 1 includes a main housing 2. Within the main housing 2, provided are a sheet supply unit 3 for supplying a sheet S (recording sheet), an image forming unit 10 for forming a toner image on the sheet transferred from the sheet supply unit 3, and a fixing device 100 for thermally fixing toner image to the sheet S.

The sheet supply unit 3 is provided in a lower portion of the main housing 2. The sheet supply unit 3 includes a sheet supply tray 31, a lifter plate 32, and a sheet supplying mechanism 33. In the sheet supply unit 3, sheets S accommodated in the sheet supply tray 31 is urged to be lifted upward toward the sheet supplying mechanism 33 by the lifter plate 32, and each of the sheets is fed out by the sheet supplying mechanism 33 toward the image forming unit 10.

The image forming unit 10 includes an exposure unit 4, and a process cartridge 5. The exposure unit 4 is provided in an upper portion of the main housing 2. Although not shown in the drawings, the exposure unit 4 includes a laser light-emitting unit, a polygon mirror, lenses, reflecting mirrors, and the like. The exposure unit 4 is configured to irradiate laser beams (indicated by dotted chain lines in FIG. 1) to expose a surface of a photosensitive drum 61 to light on a basis of image data.

The process cartridge 5 is positioned between the sheet supply tray 31 and the exposure unit 4. The main housing 2 has a front portion formed with an opening which is covered by a front cover 21. The process cartridge 5 can be pulled out of the main housing 2 through the opening by opening the front cover 21. The process cartridge 5 can be detached from and attached to the main housing 2 through the opening when the front cover 21 is open. The process cartridge 5 includes a drum unit 6 and a developing unit 7.

The drum unit 6 includes the photosensitive drum 61, a charger 62, and a transfer roller 63. The developing unit 7 is configured to be attached to and detached from the drum unit 6. The developing unit 7 includes a developing roller 71, a supply roller 72, a toner layer thickness regulation blade 73, a toner (developer) chamber 74, and an agitator 75 configured to agitate toner in the toner chamber 74.

In the process cartridge 5, the charger 62 applies a uniform charge to the surface of the photosensitive drum 61, after which the exposure unit 4 irradiates laser beams to expose surface of the photosensitive drum 61 to light for forming electrostatic latent image thereon on the basis of the image data. The toner accommodated in the toner chamber 74 is supplied to the developing roller 71 through the supply roller 72. The toner is entered into a space between the developing roller 71 and the thickness regulation blade 73, so that a thin toner layer having uniform thickness is carried on the developing roller 71.

The toner carried on the developing roller 71 is then supplied to the electrostatic latent image formed on the surface of the photosensitive drum 61. Thus, the electrostatic latent image becomes a visible toner image on the surface of the photosensitive drum 61. Then, the sheet S is conveyed between the photosensitive drums 61 and the transfer roller 63, so that the toner image formed on the photosensitive drums 61 is transferred to the sheet S.

The fixing device 100 is disposed rearward of the process cartridge 5. The toner image transferred onto the sheet S is thermally fixed upon the sheet being passed through the fixing device 100. Thereafter, the sheet S is discharged onto a discharge tray 22 by way of conveyer rollers 23, 24.

Figure 2:
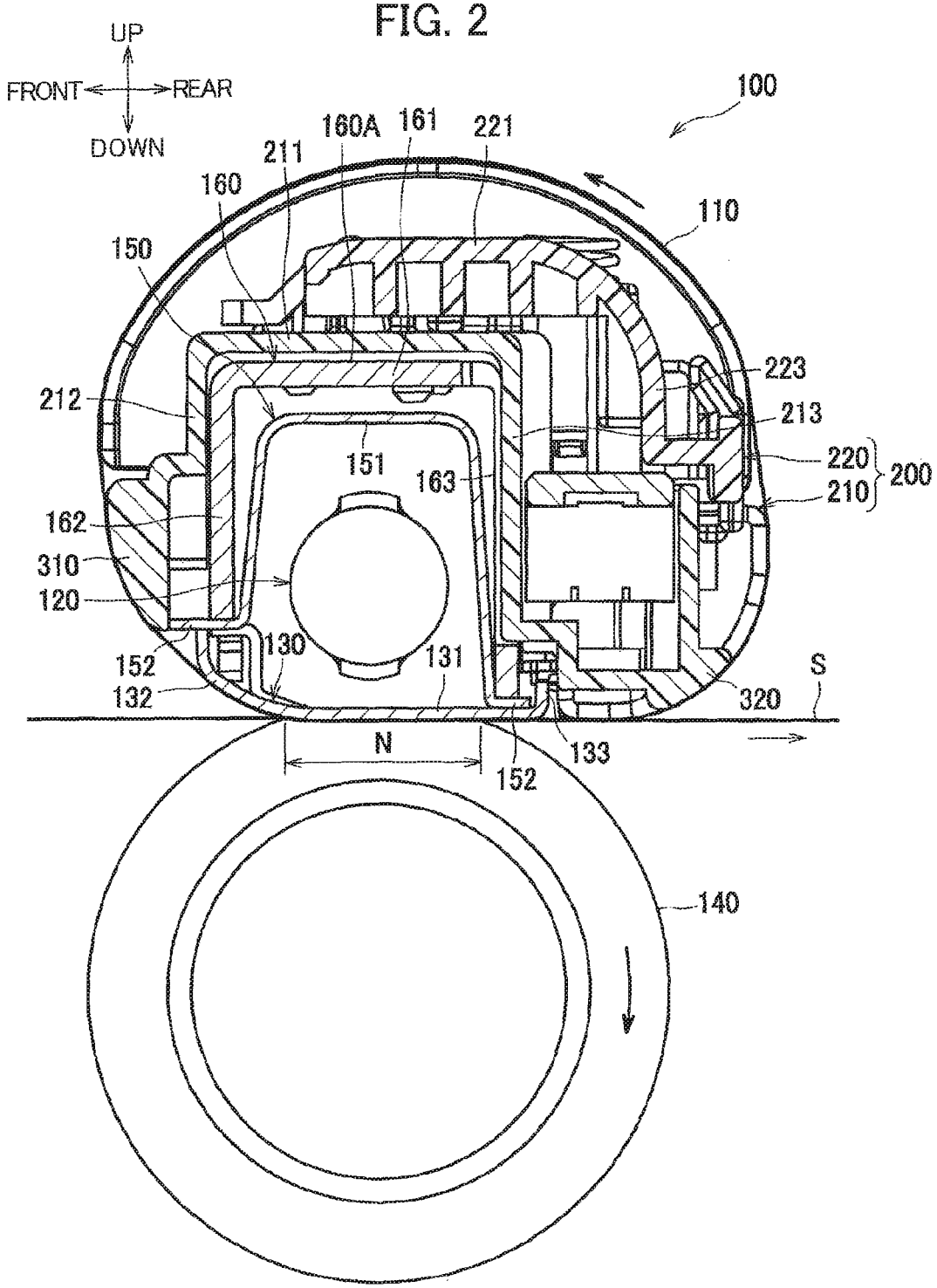
FIG. 2 is a cross-sectional view illustrating an essential portion of the fixing device according to the embodiment.

As shown in FIG. 2, the fixing device 100 includes a fixing belt 110, a heater 120, a nip plate 130, a pressure roller 140, a reflection plate 150, a stay 160, and a stay cover 200. The stay cover 200 includes an upstream guide 310 and a downstream guide 320 described later.

The fixing belt 110 is adapted to heat the sheet S on which the toner image is formed. The fixing belt 110 is in a form of an endless belt formed of a metal such as stainless steel providing heat resistivity and flexibility. The fixing belt 110 is circularly movable along the upstream guide 310 and the downstream guide 320. The fixing belt 110 defines an internal space in which the heater 120, the nip plate 130, the reflection plate 150, the stay 160 and the stay cover 200 are provided.

A halogen lamp is a typical example of the heater 120 and is adapted to generate radiant heat for heating the nip plate 130 and the fixing belt 110. The heater 120 is spaced apart at a prescribed distance from an inner surface of the nip plate 130.

The nip plate 130 is a plate-like member and contacts the inner circumferential surface of the fixing belt 110. The nip plate 130 is configured to receive radiant heat from the heater 120, and to transmit the heat to the fixing belt 110. The nip plate 130 is provided by bending a metal plate such as aluminum plate whose coefficient of thermal conductivity is higher than that of the stay 160 made from steel. The nip plate 130 includes a plate portion 131 elongated in leftward/rightward direction and in contact with the fixing belt 110, a front bent portion 132 extending upward from a front edge of the plate portion 131, a rear bent portion 133 extending upward from a rear edge of the plate portion 131.

The pressure roller 140 is disposed below the nip plate 130 so as to nip the fixing belt 110 in cooperation with the plate portion 131 of the nip plate 130. One of the nip plate 130 and the pressure roller 140 is urged toward remaining one of the nip plate 130 and the pressure roller 140 for formation of a nip region N. The pressure roller 140 has a rotational axis and is rotationally driven about the axis upon input of drive power from a drive source (not shown) disposed in the main housing 2. Thus, the pressure roller 140 is configured to convey the sheet S rearward in cooperation with the fixing belt 110, while the fixing belt 110 and the sheet S are nipped between the nip plate 130 and the pressure roller 140.

The reflection plate 150 is generally U-shaped and is made from a material providing high reflectivities for infrared ray and far infrared ray. More specifically, the reflection plate 150 includes a reflecting portion 151 having a general U-shape in cross-section covering the heater 120, and flange portions 152 extending outward in a front-rear direction from respective ends of the reflecting portion 151, the respective ends being positioned closer to the nip plate 130 than a remaining portion of the reflecting portion 151 to the nip plate 130.

A front flange portion 152 is mounted on an end face of the front bent portion 132, and a rear flange portion 152 is mounted on a rear portion of the plate portion 131 of the nip plate 130.

The stay 160 is positioned at the position opposite to the pressure roller 140 with respect to the nip plate 130. The stay 160 is adapted to support front and rear end portions of the nip plate 130 and receive force applied from the pressure roller 140 to the front and rear end portions of the nip plate 130 when load is applied from the pressure roller 140 to the nip plate 130. The stay 160 is made from a metal plate having high rigidity such as a steel plate.

Figure 3:
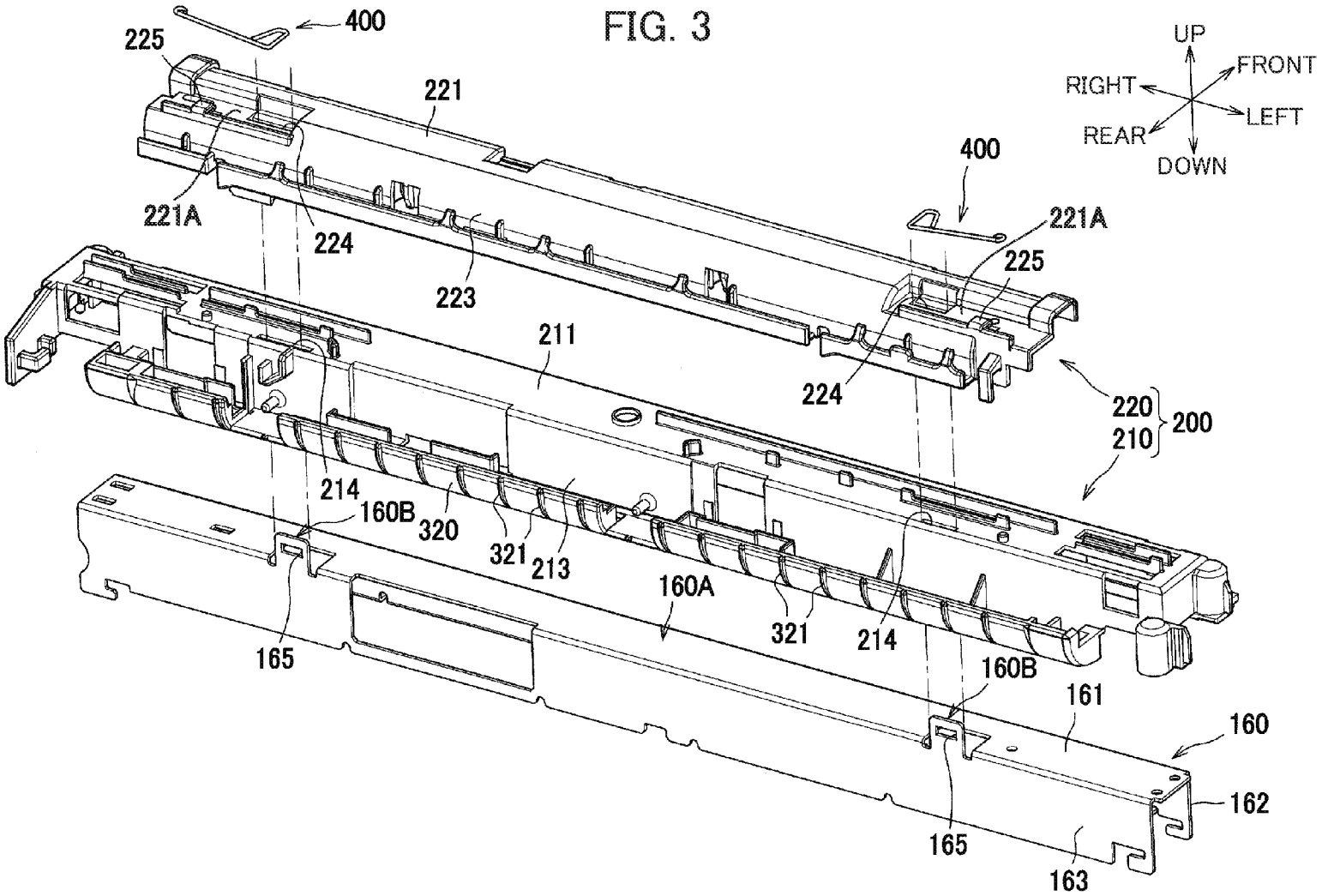
FIG. 3 is a perspective view of a stay, an inner cover, an outer cover, and a spring those being components of the fixing device.

As shown in FIG. 3, the stay 160 includes a main body 160A and a pair of plate-shaped protrusion portions 160B. The main body 160A has a substantial U-shape when viewed in the left/right direction which is the axial direction of the pressing roller 140 and extends in the left/right direction. Each of the pair of plate-shaped protrusion portions is positioned near to the both ends of the main body 160A in the left/right direction. The main body 160A includes an upper wall 161, a front wall 162 extending downward from the front edge of the upper wall 161, and a rear wall 163 extending downward from the rear edge of the upper wall 161, and is disposed inside the stay cover 200 (see FIG. 2). The protrusion portions 160B are formed at the upper edge of the rear wall 163 so as to extend upward from the positions which are close to both ends of the upper edge of the rear wall 163 in the left/right direction. Each protrusion portion 160B is provided with an engagement hole 165 which penetrates in the front/rear direction.

As shown in FIG. 2, the stay cover 200 is a member that holds the stay 160 and the nip plate 130, and is disposed inside the fixing belt 110 so as to cover the main body 160A of the stay 160. More specifically, the stay cover 200 includes an inner cover 210 and an outer cover 220. The inner cover 210 is one example of a second cover covering the upper portion, the front portion, and the rear portion of the main body 160A. The outer cover 220 is one example of a cover covering the upper portion and the rear upper portion of the main body 160A through the inner cover 210.

Each of the inner cover 210 and the outer cover 220 is formed from a heat-resistant resin. Therefore, the linear expansion coefficients of the inner cover 210 and the outer cover 220 are different from the linear expansion coefficient of the metallic stay 160. Furthermore, the inner cover 210 and the outer cover 220 may be formed from the same resin or formed from different resins.

The inner cover 210 has a substantially U-shaped cross-section when viewed in the left/right direction, extends in the left/right direction, and is disposed between the stay 160 and the outer cover 220. The inner cover 210 mainly includes an upper wall 211, a front wall 212 which extends downward from the front edge of the upper wall 211, and a rear wall 213 which extends downward from the rear edge of the upper wall 211. The lower edge of the front wall 212 is provided with the upstream guide 310 which guides the front lower portion of the fixing belt 110. And, the lower edge of the rear wall 213 is provided with a downstream guide 320 which guides the rear lower portion of the fixing belt 110. As shown in FIG. 3, a plurality of ribs 321 which guides the fixing belt 110 to circulate is provided on the downstream guide 320 side by side in the left/right direction. Further, an inner opening 214 is formed on each of the end portions in the left/right direction in the rear edge of the upper wall 211.

The outer cover 220 extends in the left/right direction and is disposed so as to cover the upper portion and the rear upper portion of the inner cover 210. The outer cover 220 mainly includes an upper wall 221 and a rear wall 223 which extends downward from the rear edge of the upper wall 221. The upper wall 211 has concaved portions 221A, 221A on end portions thereof in the left/right direction. Each of the concaved portions 221A, 221A has a surface concaved to the stay 160. An outer opening 224 as an example of an opening and an engaging portion 225 are formed at each of both end portions of the rear edge of the upper wall 211 in the left/right direction.

The inner opening 214 and the outer opening 224 are formed as slit-shaped holes, i.e., oblong hole, elongated in the left/right direction so as to be perforated in the up/down direction. Particularly, the outer opening 224 is formed on the concaved portion 221A of the outer cover 220. When the inner cover 210 and the outer cover 220 are assembled in an overlapping state, the inner opening 214 and the corresponding outer opening 224 communicate with each other in the up/down direction. The inner opening 214 and the outer opening 224 on the left side are formed so as to have the substantially same lengths in the left/right direction as the length of the protrusion portion 160B on the left side in the left/right direction. And, the inner opening 214 and the outer opening 224 on the right side are formed so as to have the length in the left/right direction which is longer than the length of the protrusion portion 160B on the right side in the left/right direction.

Figure 4A:
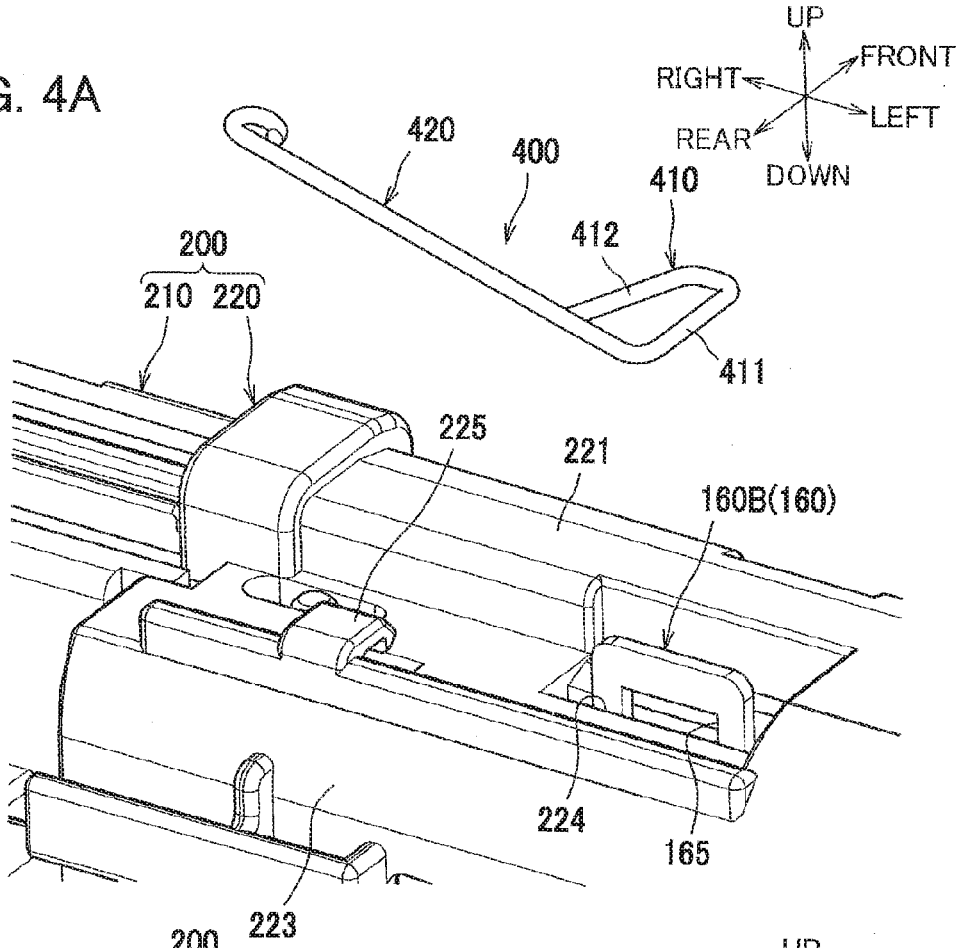
FIG. 4A is an enlarged perspective view for description of fixing of the cover to the stay in a state where the spring is separated from the cover and the stay.

As shown in FIG. 4A, the engaging portion 225 is configured to receive an arm portion 420 of a spring 400 which is described later. The engaging portion 225 is formed in a hook shape which protrudes upward from the rear edge of the upper wall 221, extends forward, and is curved downward at the front edge thereof. The engaging portion 225 is disposed at the outside the corresponding outer opening 224 in the left/right direction. Further, the engaging portion 225 is disposed at a position deviated backward in the front/rear direction with respect to the corresponding outer opening 224.

In a state where the stay 160 and the stay cover 200 (the inner cover 210 and the outer cover 220) are assembled, the protrusion portion 160B of the stay 160 passes through the inner opening 214 provided in the inner cover 210 (see FIG. 3) and the outer opening 224 provided in the outer cover 220 to protrude to the outside of the stay cover 200.

The fixing device 100 further includes a pair of springs 400 and 400 which fixes the stay cover 200 to the stay 160 (see FIG. 3). The pair of springs 400, 400 is displaced on the both side portions of the fixing device 100, respectively. The spring 400 consists of a wire spring. The spring 400 mainly includes a curved portion 410 and the arm portion 420. The curved portion 410 is curved in a substantial U-shape. The arm portion 420 extends from the curved portion 410. The curved portion 410 includes a first portion 411 and a second portion 412. The arm portion 420 is formed so as to extend from the first portion 411 which corresponds to one end of the curved portion 410 in a direction different from the extending direction of the first portion 411. Specifically, the arm portion 420 extends from the first portion 411 toward the second portion 412 as the other end of the curved portion 410. More specifically, as indicated by the two-dotted chain line in FIG. 5, the arm portion 420 is formed so as to extend from the first portion 411 of the curved portion 410 and cross the extending direction of the second portion 412. Accordingly, when the spring 400 is in a released state from the stay cover 200, the spring 400 is in the form that the curved portion 410 and the arm portion 420 are deviated from each other in the up/down direction.

Figure 4B:
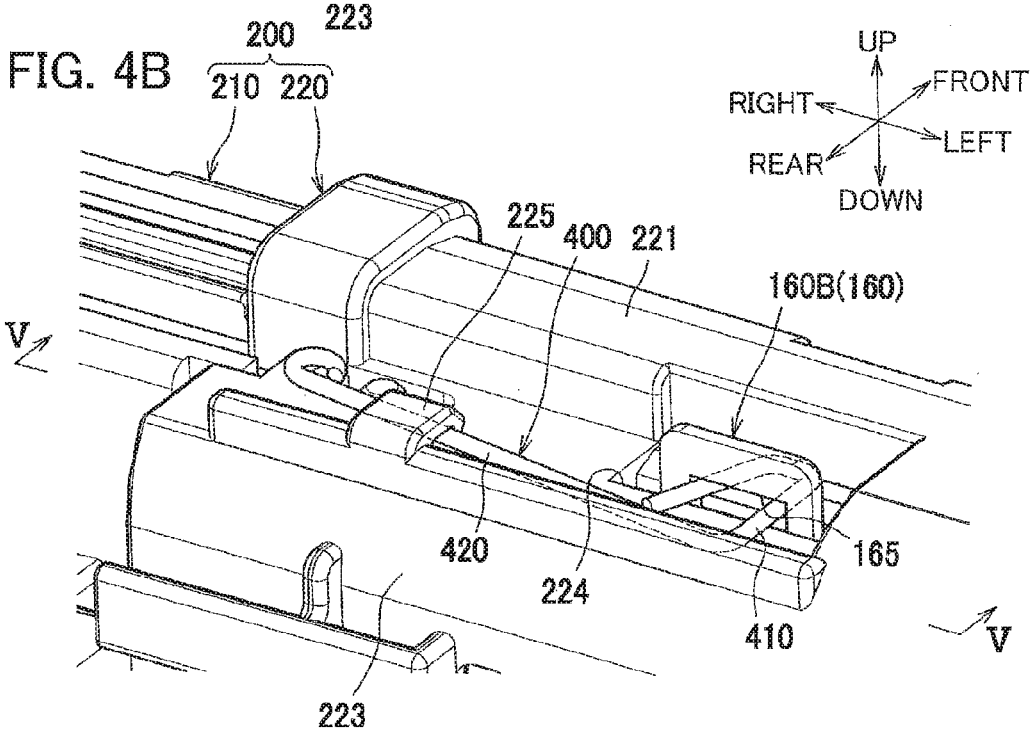
FIG. 4B is an enlarged perspective view for description of fixing of the cover to the stay in a state where the spring is assembled to the cover and the stay.

As shown in FIG. 4B, when the curved portion 410 (the first portion. 411 and the second portion 412) of the spring 400 is inserted into the engagement hole 165, one end portion of the spring 400 is engaged with the protrusion portion 160B of the stay 160. When the arm portion 420 is engaged with the engaging portion 225, the other end portion of the spring 400 is engaged with the outer cover 220.

The spring 400 is placed at each of both end portions of the stay cover 200 in the left/right direction. Furthermore, in this embodiment, since the protrusion portion 160B for fixing the stay cover 200 to the stay 160, the engaging portion 225, and the spring 400 are substantially bilaterally symmetrical to each other, only the right configuration is shown in FIGS. 4 and 5.

When the stay 160 and the stay cover 200 are fixed, each protrusion portion 160B of the stay 160 is passed through the corresponding inner opening 214 and the outer opening 224 of the stay cover 200 so as to assemble the stay 160 and the stay cover 200. Next, the curved portion 410 of the spring 400 becomes engaged in the engagement hole 165 of the protrusion portion 160B protruding to the outside of the stay cover 200 from the rear side. Then, the arm portion 420 of the spring 400 is inserted under the engaging portion 225 of the outer cover 220 while the arm portion is bent downward and forward so that the arm portion 420 is engaged with the engaging portion 225 from the downside.

Figure 5:
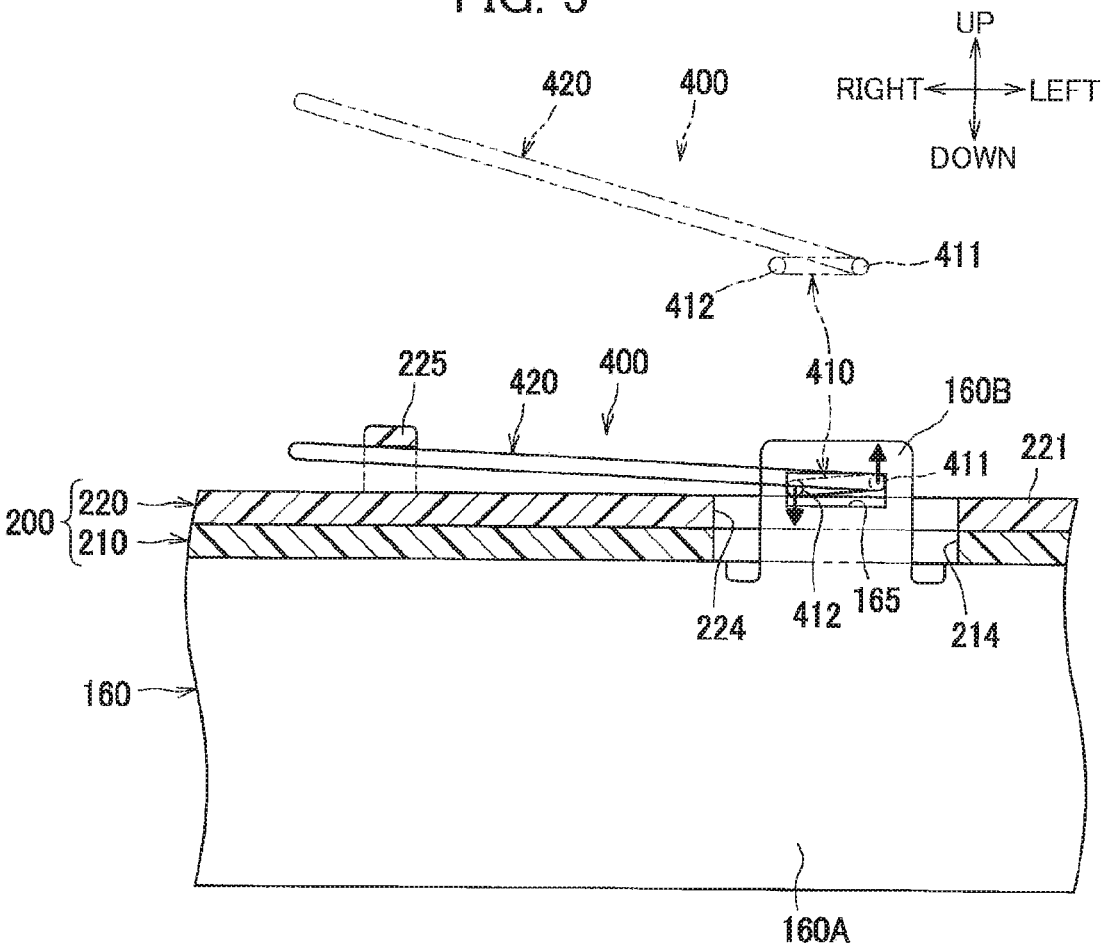
FIG. 5 is a cross-sectional view taken along a line V-V in FIG. 4B.

As shown in FIG. 5, the spring 400 urges the stay cover 200 to the stay 160. More specifically, after the curved portion 410 of the spring 400 is engaged in the engagement hole 165, the arm portion 420 extending obliquely upward from the curved portion 410 is engaged with the engaging portion 225 while being bent downward. Therefore, the first portion 411 of the curved portion 410 comes to contact (is engaged with) the upper edge of the engagement hole 165 of the protrusion portion 160B due to the restoring force to press the stay 160 upward. At the same time, the second portion 412 of the curved portion 410 comes to contact the upper wall 221 of the outer cover 220 to press the outer cover 220 (the stay cover 200) downward due to the restoring force. Accordingly, the first portion 411 of the spring 400 presses the stay 160 upward to urge the main body 160A of the stay 160 against the stay cover 200. And, the second portion 412 of the spring 400 presses the stay cover 200 downward to urge the stay cover 200 against the main body 160A of the stay 160.

According to the above-described embodiment, since the stay cover 200 and the stay 160 can be fixed by the spring 400, the generation of chips can be suppressed, compared to a case where the stay cover is fixed to the stay by a screw. Accordingly, for example, the damage on the inner peripheral surface of the fixing belt 110 can be suppressed. Hence the lifetime of the fixing device 100 can be extended.

Further, since the protrusion portion 160B of the stay 160 is provided with the engagement hole 165 into which the curved portion 410 (the first portion 411 and the second portion 412) of the spring 400 is inserted, the first portion 411 of the spring 400 can be engaged with the protrusion portion 160B with a simple configuration.

Further, since the stay cover 200 (the outer cover 220) is provided with the hook-shaped engaging portion 225 which is engaged with the arm portion 420 of the spring 400, the arm portion 420 can be relatively easily engaged with the stay cover 200.

Further, in this embodiment, the linear expansion coefficient of the inner cover 210 and the outer cover 220 is different from the linear expansion coefficient of the stay 160. However, in the configuration in which the stay cover is fixed by the spring 400, the inner cover 210, the outer cover 220, or the stay 160 can slightly move to each other, compared to the configuration in which the stay cover is fixed by the screw. Accordingly, for example, even when the inner cover 210 and/or the outer cover 220 formed from resin is expanded, the influence of the expansion (a change in dimension) can be absorbed.

Further, since the right inner opening 214 and the outer opening 224 are formed as oblong holes which are longer than the protrusion portion 160B in the left/right direction, a problem in which the protrusion portion 160B is caught by the edge of the inner opening 214 or the outer opening 224 when the inner cover 210 or the outer cover 220 is expanded can be suppressed. Further, a change in dimension when the inner cover 210 or the outer cover 220 is expanded can be appropriately absorbed.

Further, since the ribs 321 that guide the circulation of the fixing belt 110 are provided on the downstream guide 320 of the inner cover 210, the fixing belt 110 can be rotated smoothly. More specifically, it is not easy to provide a rib in the vicinity of a portion protruding between the nip plate 130 and the pressing roller 140 on the fixing belt 110 in the outer cover 220 covering the upper portion of the stay 160. However, since the inner cover 210 having the ribs 321 is provided between the stay 160 and the outer cover 220, the fixing belt 110 protruding between the nip plate 130 and the pressing roller 140 can be guided smoothly.

Further, since the stay 160 (the main body 160A) is formed in a substantial U-shape and supports both end portions of the nip plate 130 in the front/rear direction when a load is applied from the pressing roller 140 to the nip plate 130, the load applied to the nip plate 130 can be suitably received by the stay 160.

While the description has been made in detail with reference to specific embodiment, it would be apparent to those killed in the art that various changes and modifications may be made therein without departing from the scope of the above described embodiment.

In the above-described, embodiment, the wire spring 400 is employed. However, a leaf spring or a coil spring is available instead of the wire spring.

Further, in the above-described embodiment, the metallic film is employ as the fixing belt 110. However, a resin film having heat resistivity is also available as the fixing belt. Further, the fixing belt can be formed of a single layer of metallic film or a resin film. Alternatively, the fixing belt can be provided by a plurality of layers including a metallic film or a resin film as a base layer, and at least one layer of fluorine resin layer or a rubber layer coated over the base layer.

Further, in the above-described embodiment, the halogen lamp (halogen heater) is used as the heater 120. However, a carbon heater is also available.

Further, in the above-described embodiments, the nip plate 130 includes the plate portion 131 and front and rear bending portions 132, 133. However, a flat plate is also available as the nip plate.

Further, in the above-described embodiment, the stay 160 and the reflection plate 150 are components separate from each other. However, a stay 160 can also have a reflection function by effecting mirror-like finishing on an inner surface of the stay 160.

Further, in the above-described embodiment, the stay cover 200 includes two covers, i.e., the inner cover 210 and the outer cover 220. However, the stay cover 200 can be provided by a single cover, or not less than three covers.

Further, in the above-described embodiment, the monochromatic laser printer 1 for forming monochrome image on a sheet S is exemplified as the image forming device. However, a color printer, a copying machine provided with an image reader such as a flat-bed scanner, and a multi-function device are also available.

In the above-described embodiment, the upper cover 220 has concaved portions 221A on the end portions of the upper wall 221 in the left/right direction. However, the inner cover 210 can have concaved portions on the both end portions of the upper wall 211 in the left/right direction. The concaved portion on the upper wall 211 is concaved to the stay 160 to form the opening 214.

What is claimed is:

1. A fixing device comprising:

a fixing belt having an inner surface;

a heater configured to heat the fixing belt;

a nip plate configured to contact the inner surface;

a pressure roller configured to press the fixing belt in cooperation with the nip plate;

a stay provided at a position opposite to the pressure roller with respect to the nip plate, the stay being configured to receive a force applied to the nip plate from the pressure roller;

a cover configured to cover the stay; and a spring comprising a first portion in contact with the stay and configured to urge the stay to the cover, and a second portion in contact with the cover and configured to urge the cover to the stay to provide fixing between the stay and the cover.

2. The fixing device according to claim 1, wherein the cover is formed with an opening, and wherein the stay comprises a main body positioned in the cover, and a protrusion portion protruding to outside of the cover through the opening, the first portion of the spring configured to be engaged with the protrusion portion.

3. The fixing device according to claim 2, wherein the protrusion portion is formed with an engagement hole in which the first portion and the second portion are inserted.

4. The fixing device according to claim 3, wherein the engagement hole is positioned outside of the cover and away from the opening.

5. The fixing device according to claim 2, wherein the spring is a wire spring having a curved portion and an arm portion, the curved portion being curved in a U-shape and configured to be engaged with the protrusion portion, the arm portion extending from one end of the curved portion in a direction crossing an extending direction of the curved portion, the curved portion comprising the first portion and the second portion.

6. The fixing device according to claim 5, wherein the cover comprises an engaging portion having a hook shape, the engaging portion configured to be engaged with the arm portion.

7. The fixing device according to claim 6, wherein the engaging portion is positioned at a position away from the opening in an axial direction of the pressure roller.

8. The fixing device according to claim 6, wherein the fixing belt circulates in a sheet conveying direction, and wherein the engaging portion is positioned at a position deviated from the opening in the sheet conveying direction.

9. The fixing device according to claim 2, wherein the pressure roller has a rotational axis extending in an axial direction, and wherein the opening is an oblong hole extending in the axial direction.

10. The fixing device according to claim 9, wherein the opening has a length in the axial direction which is longer than that of the protrusion portion.

11. The fixing device according to claim 2, wherein the cover comprises a first cover and a second cover, and the opening includes a first opening and a second opening, and wherein the first cover is formed with the first opening through which the protrusion portion passes, and the second cover is formed with the second opening through which the protrusion portion passes.

12. The fixing device according to claim 2, wherein the pressure roller has a rotational axis extending in an axial direction, and wherein the opening includes a first opening and a second opening, the first opening being formed on one end portion of the cover in the axial direction, and the second opening being formed on another end portion of the cover in the axial direction.

13. The fixing device according to claim 1, wherein the cover has a linear expansion coefficient different from that of the stay.

14. The fixing device according to claim 1, further comprising a second cover configured to be positioned between the stay and the cover, the second cover comprising a rib configured to guide the fixing belt to circularly move.

15. The fixing device according to claim 1, wherein the pressure roller has a rotational axis extending in an axial direction, and wherein the stay has a U-shape when viewed in the axial direction of the pressure roller, the stay being configured to support the nip plate when a load is applied from the pressure roller to the nip plate.

16. A fixing device comprising:

a fixing belt having an inner surface, a heater configured to heat the fixing belt;

a nip plate configured to contact the inner surface, a pressure roller configured to press the fixing belt in cooperation with the nip plate;

a stay provided at a position opposite to the pressure roller with respect to the nip plate, the stay being configured to receive a force applied to the nip plate from the pressure roller;

a cover configured to cover the stay; and a spring comprising a first portion configured to urge the stay to the cover, and a second portion configured to urge the cover to the stay, wherein the pressure roller has a rotational axis extending in an axial direction, wherein the cover comprises an end portion in the axial direction, and wherein the spring is positioned at the end portion of the cover in the axial direction.

17. A fixing device comprising:

a fixing belt having an inner surface;

a heater configured to heat the fixing belt, a nip plate configured to contact the inner surface;

a pressure roller configured to press the fixing belt in cooperation with the nip plate;

a stay provided at a position opposite to the pressure roller with respect to the nip plate, the stay being configured to receive a force applied to the nip plate from the pressure roller;

a cover configured to cover the stay; and a spring comprising a first portion configured to urge the stay to the cover, and a second portion configured to urge the cover to the stay, wherein the cover includes an outer surface having a concaved portion which is concaved to the stay, the spring being placed in the concaved portion.

* * * * *